US005664665A

United States Patent [19]

Kobayashi et al.

[11] Patent Number: 5,664,665

[45] Date of Patent: Sep. 9, 1997

[54] SHOCK SENSOR

[75] Inventors: Tatsuo Kobayashi; Kiyotaka Nakamura; Hisaharu Matsueda; Kayoko Makiki; Isamu Hamazaki; Kazuya Watanabe, all of Tokyo, Japan

[73] Assignee: Oki Electric Industry Co. Ltd., Japan

[21] Appl. No.: 617,576

[22] Filed: Mar. 19, 1996

Related U.S. Application Data

[63] Continuation of Ser. No. 193,098, filed as PCT/JP93/00790 Jun. 14, 1993.

[30] Foreign Application Priority Data

| | | | |
|---|---|---|---|
| Jun. 12, 1992 | [JP] | Japan | 4-179007 |
| Jul. 21, 1992 | [JP] | Japan | 4-216496 |
| Oct. 16, 1992 | [JP] | Japan | 4-304562 |

[51] Int. Cl.[6] ..... H01H 35/14

[52] U.S. Cl. ..... 200/61.45 M; 335/205

[58] Field of Search ..... 200/61.45 R–61.45 M, 200/61.48, 61.49, 61.5, 61.51, 61.52, 61.53; 335/205–207, 151–153

[56] References Cited

U.S. PATENT DOCUMENTS

| | | | |
|---|---|---|---|
| 3,439,137 | 4/1969 | Green et al. | 200/61.45 |
| 4,112,401 | 9/1978 | Palmer et al. | 335/206 |
| 4,639,563 | 1/1987 | Gunther | 200/61.45 M |
| 4,705,922 | 11/1987 | Seeger et al. | 200/61.45 M |
| 5,010,216 | 4/1991 | Sewell et al. | 200/61.45 M |

FOREIGN PATENT DOCUMENTS

| | | |
|---|---|---|
| 52-47078 | 10/1977 | Japan . |
| 1-61665 | 4/1989 | Japan . |
| 4-164258 | 6/1992 | Japan . |

*Primary Examiner*—Lincoln Donovan
*Assistant Examiner*—Michael A. Friedhofer
*Attorney, Agent, or Firm*—Edward D. Manzo; Mark J. Murphy

[57] ABSTRACT

A shock sensor capable of detecting a shock in a number of directions includes a reed switch, which is fixed inside a body and has a reed contact part which is magnetically changed from a first to a second state by way of a magnet, which is fixed inside the body at a specified distance from the reed switch. A shield member, having a sufficiently large area, prevents the magnet force of the magnet from affecting the reed contact part when the shield member is in its regular position. A resilient member, in a normal state, keeps the shield member at its regular position between the reed contact part and a magnet, at which the reed contact part is kept in the first state. When a shock is applied to the shock sensor, the resilient member allows the shield member to move to a position where the reed contact part changes over to the second state.

In a second embodiment, the magnet is movably held in the main casing at a specified distance from the reed switch. In a normal state, the position of the magnet is such that a magnetism does not affect the reed contact part. When a shock is applied to the shock sensor, the magnet moves to a second position where the reed contact part is changed over to the second state.

11 Claims, 7 Drawing Sheets

SHOCK SENSOR

This application is a continuation of copending U.S. application Ser. No. 08/193,098, filed on Jun. 7, 1994, which is a U.S. national stage application of PCT/JP93/00790 filed on Jun. 14, 1993, and was allowed on Mar. 23, 1996.

TECHNICAL FIELD

The present invention relates to a shock sensor and, more particularly, to a shock sensor suited for use in a safety air bag system for automobiles.

BACKGROUND ART

Safety air bag systems for use in automobiles which respectively employ a shock sensor for sensing a shock which will be applied to a vehicle upon collision with the other vehicle or an object are intended to protect a driver from such a shock by starting an actuator for the safety air bag system with an output signal from the sensor which has sensed the collision shock, and inflating the air bag.

FIGS. 1 and 2 respectively show an example of this type of conventional shock sensor.

FIG. 1 shows a shock sensor which utilizes a magnetic repulsion force of magnets.

This example of the conventional shock sensor in FIG. 1 is adapted to employ a main casing 141 having tunnel type chambers 142 and 143, which are provided parallel to each other, to house a reed switch 144 in one tunnel type chamber 142 and a pair of rod type magnets 145 and 146 in the other tunnel type chamber 143 so that the same magnetic poles (S pole in this example) of these magnets are arranged to oppose each other; for example, one rod type magnet 145 is slidably provided and the other rod type magnet 146 is fixed.

This shock sensor is arranged so that the slidable rod type magnet 145 is positioned in a direction opposing to the direction of the shock to be detected.

In this shock sensor, a pair of magnets 145 and 146 are kept at a position shown in FIG. 1, that is, a position away from the contact part 144*a* of the reed switch 144 by their magnetic repulsion force in a normal state where no shock is applied.

When the shock sensor receives a shock in a direction where the shock sensor expects the shock in this normal state, the rod type magnet 145 slidably provided moves against the magnetic repulsion force produced between the rod type magnet 145 and the fixed rod type magnet 146 to approach the contact part 144*a* of the reed switch 144 and actuates the reed switch 144 by applying magnetism to this contact part 144*a* and the shock sensor detects the shock.

FIG. 2 shows a shock sensor which utilizes spring resilience.

This example of the conventional shock sensor in FIG. 2 is provided with a main casing 251 having tunnel type chambers 252 and 253 which are arranged parallel to each other, the tunnel type chamber 252 being adapted to incorporate a reed switch 254 and the tunnel type chamber 253 being adapted to incorporate a rod type magnet 255 to be slidable, and thereby the rod type magnet 255 is energized by the spring 256 to move away from the contact part 254*a* of the reed switch 254.

In this shock sensor, the magnet 255 is kept at a position shown in FIG. 2, that is, a position away from the contact part 254*a* of the reed switch 254 by the resilience of the spring 256 in the normal state where no shock is applied.

When a shock is applied to the shock sensor in this normal state in the lengthwise direction of the reed switch 254 where the resilience of the spring 256 is reduced, the magnet 255 moves against the resilience of the spring 256 to approach the contact part 254*a* of the reed switch 254 whereby the reed switch 254 is actuated by applying the magnetism to the contact part 254*a* and thus the shock sensor detects a shock.

Any example of conventional shock sensors with the configuration as described above is provided with the magnets which are arranged to be slidable in the lengthwise direction of the reed switch and therefore, there has been a problem that the reed switch operates only with a shock applied to one side of the lengthwise direction of the reed switch and does not operate with a shock applied to the opposite side.

An object of the present invention made in view of the above problem is to provide a shock sensor capable of detecting a shock in a number of directions. Another object of the present invention is to provide a shock sensor capable of allowing to conduct operation tests more easily.

SUMMARY OF THE INVENTION

A first aspect of the present invention made to solve the above problem specifies a shock sensor comprising a reed switch which is fixed inside a body and has a reed contact part which is changed from a first to a second state under the influence of magnetism; a magnet which is fixed inside the body at a specified distance from the reed switch; a shield member which has an area as large as enough to prevent a magnetic force of the magnet from affecting the reed contact part when the shield member is located at a regular position; and a resilient member which keeps the shield member at the fixed position between the reed contact part and the magnet where the shield member keeps the reed contact part in the first state so that the shield member is movable to a position where the reed contact part is permitted to move to the second state when the shock is detected.

A second aspect of the present invention specifies a shock sensor comprising a reed switch which is fixed inside a body and has a reed contact part which is changed from a first to a second state under the influence of magnetism; and a magnet which is kept in the body to be movable with a specified distance from the reed switch so that the magnet is kept at a regular position where the magnetism of the magnet does not affect the reed switch in a normal state and which moves to a position where the reed contact part is changed to the second state when a shock is detected, the body being provided with an opening for forcibly moving the magnet.

BEST MODE FOR CARRYING OUT THE INVENTION

Based on the accompanying drawings, preferred embodiments of the present invention are described in detail below.

Figure 1:
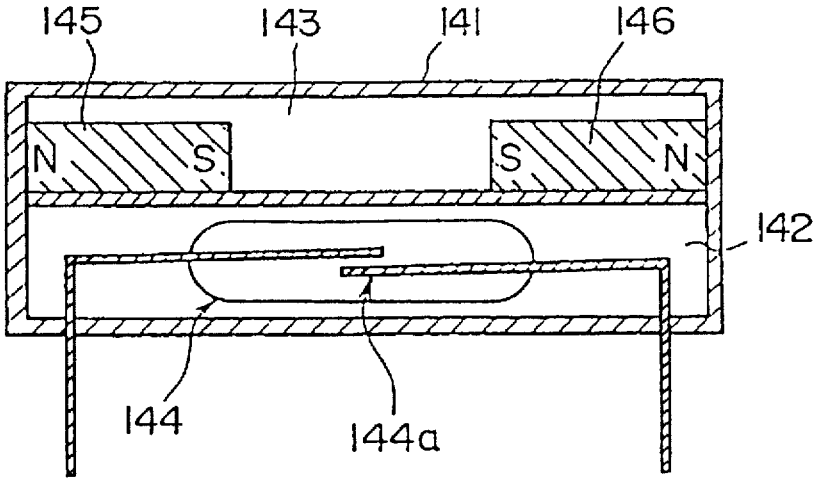
FIG. 1 PRIOR ART
FIGS. 1 and 2 are respectively a cross-sectional side view of a conventional shock sensor.
Figure 2:
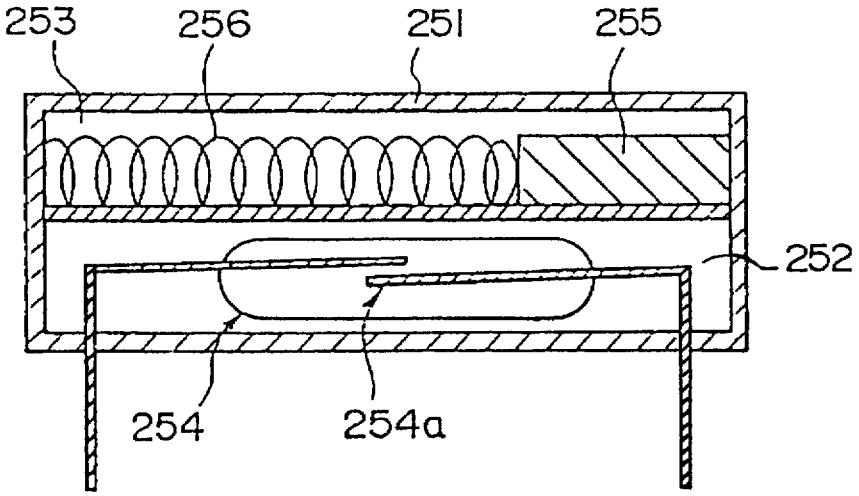
FIG. 2 PRIOR ART
Figure 3:
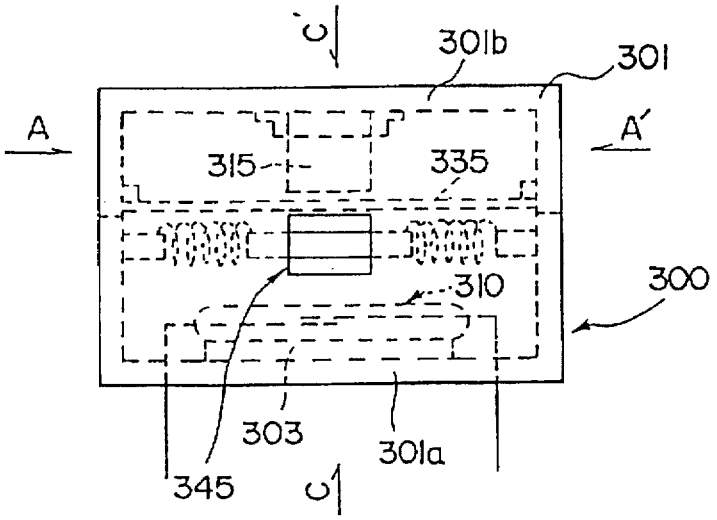
FIG. 3 is a side view of a shock sensor 300, a first embodiment of the present invention.
Figure 4:
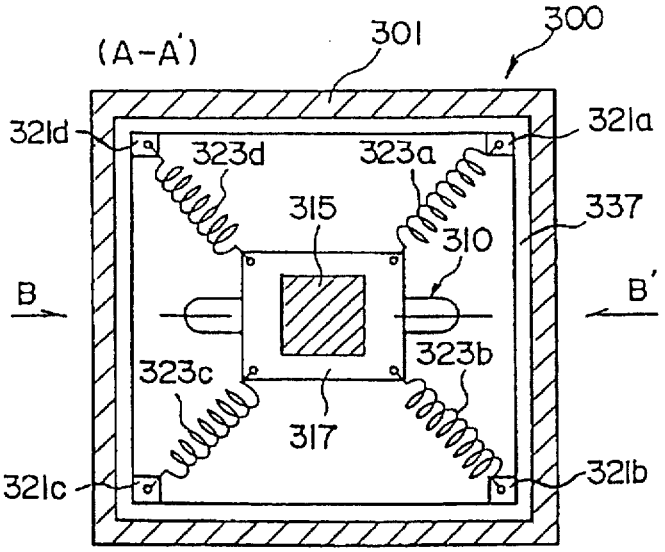
FIG. 4 is a partial cross-sectional approximate illustration as viewed along line A—A' of the shock sensor 300 of FIG. 3.
Figure 5:
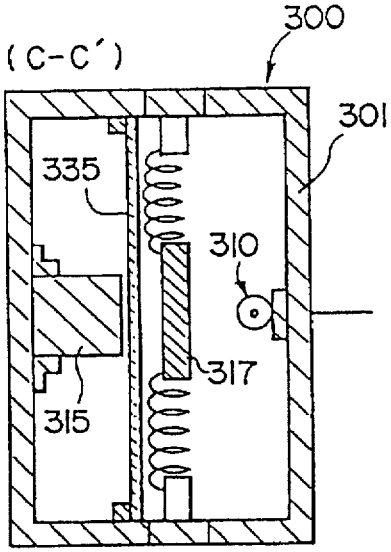
FIG. 5 is a partial cross-sectional approximate illustration as viewed along line C—C' of the shock sensor 300 of FIG. 3.
Figure 6:
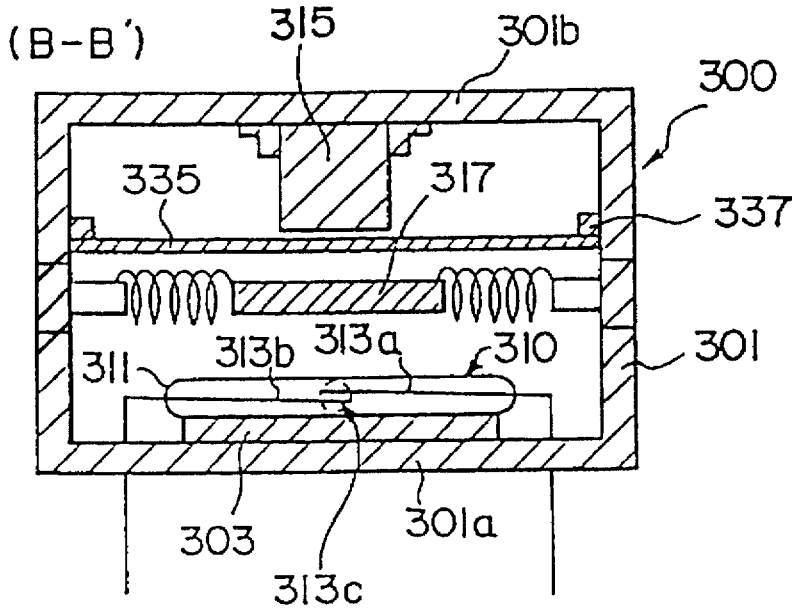
FIG. 6 is a partial cross-sectional approximate illustration as viewed along line B—B' of the shock sensor 300 of FIG. 4.

FIG. 3 is a side view of a shock sensor 300, a first embodiment of the present invention;

FIG. 4 is a partial cross-sectional approximate illustration as viewed along line A—A' of the shock sensor 300 of FIG. 3;

FIG. 5 is a partial cross-sectional approximate illustration as viewed along line C—C' of the shock sensor 300 of FIG. 3;

FIG. 6 is a partial cross-sectional approximate illustration as viewed along line B—B' of the shock sensor 300 of FIG. 4.

Referring to FIGS. 3–6, the configuration of the shock sensor 300 is described below.

The shock sensor 300 has a rectangular main casing 301 made of relatively thick vinyl chloride sheet. A reed switch 310 is fixed on a vinyl chloride base 303 at the center of an inside bottom 301*a* of the main casing 301. The reed switch 310 is formed with a pair of reeds 313*a* and 313*b* which are hermetically sealed in a glass tube 311 together with an inert gas and has a pair of reeds 313*a* and 313*b* whose contact parts 313*c* are overlapped with a specified clearance. The contact parts 313*c* close when an external magnetic field is applied thereto.

On the other hand, at the center of an internal upper surface 301*b* of the main casing 301, a rod type magnet 315 is fixed to the main casing 301 to be parallel with the reed switch 310 with a specified clearance between the rod type magnet 315 and the contact part 313*c* of the reed switch 310. The rod type magnet 315 is magnetized, for example, in a lengthwise direction of the reed switch 310.

An electromagnetic shield plate 317 of, for example, a rectangular shape, made of electromagnetic mild steel or the like, is arranged in a clearance between the reed switch 310 and the rod type magnet 315.

The electromagnetic shield plate 317 whose four corners are respectively connected to projections 321*a*, 321*b*, 321*c*, and 321*d* which are fixed inside the main casing 301 through springs 323*a*, 323*b*, 323*c*, and 323*d* is supported by the main casing 301. In a normal state, the electromagnetic shield plate 317 is kept by the springs 323*a*, 323*b*, 323*c*, and 323*d* at a position at which its central part faces the contact part 313*c*. The shape and size of the electromagnetic shield plate 317 are determined taking into account the working value of the reed switch 310, the magnitude of magnetic force of the rod type magnet 315, and the spring constants of the springs 323*a*, 323*b*, 323*c*, and 323*d*.

A vinyl chloride partition 335 of 1 to 2 mm in thickness is fixed through connecting members 337 between the electromagnetic shield plate 317 and the rod type magnet 315 inside the main casing 301. The vinyl chloride partition 335 is intended to prevent the electromagnetic shield plate 317 from being magnetically attracted by the rod type magnet 315 due to external vibration.

A test opening 345 is formed at the center of each side of the main casing 301. The test opening 345 is described later.

Referring again to FIGS. 3–6, the operation of the shock sensor 300 of the above configuration is described below.

In the normal state in which no shock is applied to the shock sensor, the springs 323*a*, 323*b*, 323*c*, and 323*d* hold the electromagnetic shield plate 317 at a position where its central part faces the contact part 313*c* of the reed switch 310, and the magnetism from the rod type magnet 315 is shut off by the electromagnetic shield plate 317. Therefore, since no magnetic effect acts on the contact part 313*c* of the reed switch 310, this contact part is kept open.

When the shock sensor detects a shock in this normal state, the electromagnetic shield plate 317 moves against the resilience of the springs in the direction opposite to the direction of the shock. This movement of the electromagnetic shield plate 317 causes a magnetic force of the rod type magnet 315 to act on the contact part 313*c* of the reed switch 310, so that this contact part is consequently closed to turn on the reed switch 310. Turning on of the reed switch 310 actuates shock detecting means (not shown) which is connected to the reeds 313*a* and 313*b* of the reed switch 310 to detect the shock.

Figure 7:
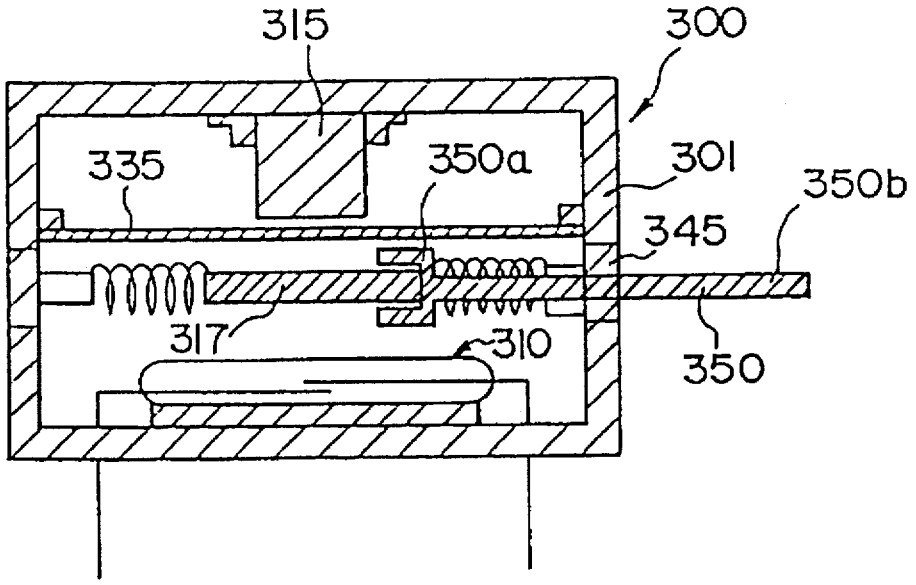
FIG. 7 is an illustration of the procedure for testing the shock sensor 300.

Referring to FIG. 7, the procedure for testing the shock sensor 300 is described below. The test of the shock sensor 300 is conducted with a testing jig 350. This testing jig is composed of a U-shaped abutment (T-shaped portion with fins) 350*a* which comes in contact with the electromagnetic shield plate 317 and a shank 350*b*. The testing jig 350 is inserted into the main casing 301 through the test opening 345 of the shock sensor 300. The U-shaped abutment 350*a* pushes the electromagnetic shield plate 317 to move it from the normal position. The movement of the electromagnetic shield plate 317 enables to test the shock sensor 300 without applying a shock thereto. The shock sensor 300 of the above configuration is capable of sensing a shock in all directions ranging from 0° to 360° which are parallel with the electromagnetic shield plate 317. In other words, if the position of the electromagnetic shield plate 317, opposing to the contact part 313*c* of the reed switch 310, coincides with the extending directions of the springs 323*a*, 323*b*, 323*c*, and 323*d* when the electromagnetic shield plate 317 is supported at a regular position by the springs, the shock sensor 300 can detect a shock in all directions ranging from 0° to 360°, which are parallel with the electromagnetic shield plate 317, around the position of the electromagnetic shield plate 317, opposing to the contact part 313*c*. If three springs are installed with a 120° angle interval therebetween instead of the springs 323*a*, 323*b*, 323*c*, and 323*d*, the same effect can be obtained. The sensitivity of the shock sensor 300 depends on the resultant resilience of a plurality of springs out of four springs 323*a*, 323*b*, 323*c*, and 323*d* and differs with the direction of a shock. In addition, the resilience (spring constants) of springs 323*a*, 323*b*, 323*c*, and 323*d* can be changed to adjust the sensitivities of the shock sensor 300 to shocks in different directions.

In the first embodiment described above, the partition 335 is used. However, a non-magnetic member can be formed on the magnet 315 side of the electromagnetic shield plate 317 in place of the partition to prevent attraction between the electromagnetic shield plate 317 and the magnet 315.

Figure 8:
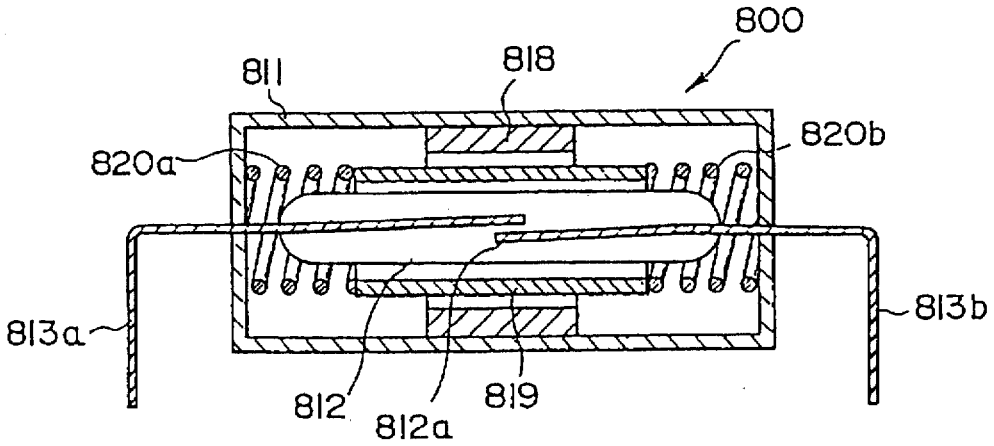
FIG. 8 is a partial cross-sectional approximate illustration of the shock sensor 800, a second embodiment of the present invention.

FIG. 8 is a cross-sectional side view showing a second embodiment of the present invention.

In FIG. 8, a ring type magnet 818 is provided around a contact part 812*a* of a reed switch 812 housed in a main casing 811 and is fixed on its internal surface.

An electromagnetic shield tube 819 made of electromagnetic mild steel or the like is provided in a clearance between the contact part 812*a* of the reed switch 812 and the ring type magnet 818 to be movable in a lengthwise direction of the reed switch 812, and is held by springs 820*a* and 820*b* at both its ends to face the central part of the electromagnetic shield tube 819 with the contact part 812*a*.

Figure 9:
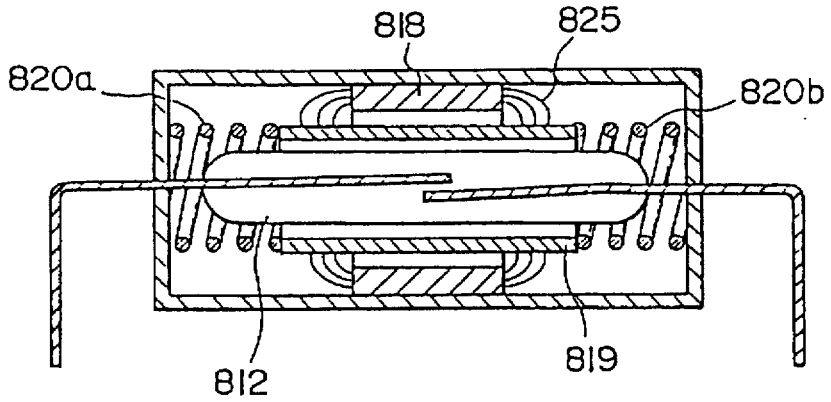
FIGS. 9 and 10 are respectively an illustration of the principle of sensing operation of the shock sensor 800.
Figure 10:
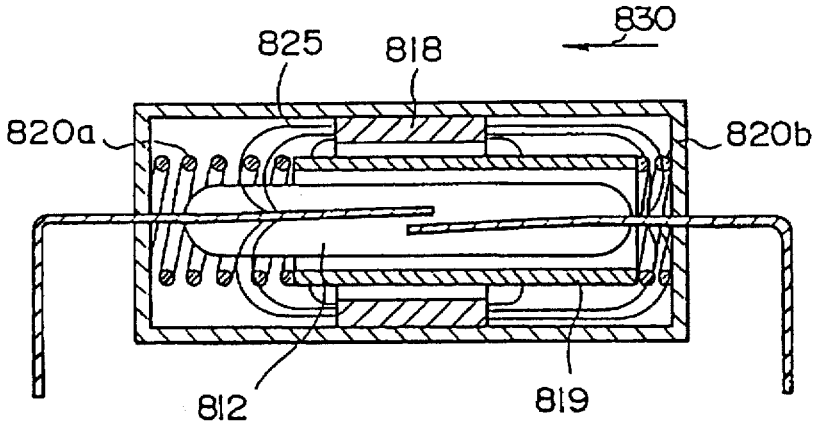

Referring to FIGS. 9 and 10, the operation of a shock sensor 800 is described below.

When no shock is applied to the shock sensor 800 as shown in FIG. 9, the reed switch 812 is not magnetized because the effect of magnetism from the ring type magnet 818 is shut off by the electromagnetic shield tube 819 as indicated by electric lines of force 825 in the figure, and therefore, the reed switch 812 remains open.

When a shock is applied to the shock sensor 800 in the arrowhead direction 830 shown in FIG. 10, a magnetism from the magnet 818 acts on the reed switch 812 as indicated by the electric lines of force 825 because the shielding effect is partly lost on account of the movement (in the right direction in FIG. 10) of the electromagnetic shield tube 819, caused by the influence of the shock. As a result, part of the terminal of the reed switch 812 is magnetized under the influence of magnetism, and therefore, the contact part 812*a* is also magnetized and the contact is closed.

As described above, the shock sensor using the ring type magnet 818 can sense a shock only in a lengthwise direction of the reed switch 812 as the conventional shock sensors because the movement of the electromagnetic shield tube 819 is limited to the lengthwise direction of the reed switch 812. However, a problem of damage of the magnets due to collision can be solved because the ring type magnet 818 is fixed.

In the above-described embodiments, springs are used as resilient members but these members are not limited to springs and can be, for example, rubber-type resilient members. In brief, any member is acceptable which can hold the electromagnetic shield plate 315 or the electromagnetic shield tube 819 at a position where the central part of the electromagnetic shield plate 315 or the electromagnetic shield tube 819 faces the contact part of the reed switch and which can elastically support the electromagnetic shield plate 315 or the electromagnetic shield tube 819 so that the electromagnetic shield plate or the electromagnetic shield tube can move when a shock is applied.

Figure 11:
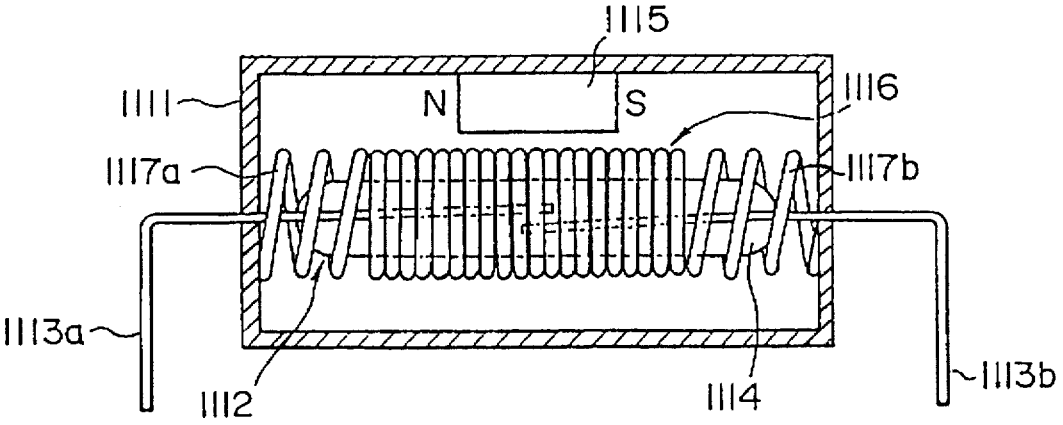
FIG. 11 is a side view of the interior of the main casing of a third embodiment of the present invention.

FIG. 11 is a side view of the interior of the main casing showing a third embodiment of the present invention.

Figure 12:
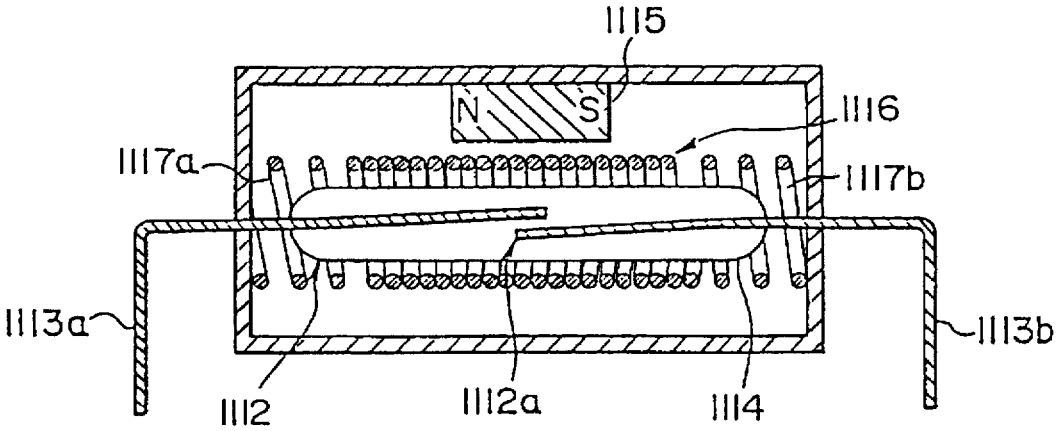
FIG. 12 is a cross-sectional side view of the main casing.

FIG. 12 is a cross-sectional side view of the main casing.

In FIG. 11, a main casing 1111 incorporates a reed switch 1112 comprising a pair of reeds 1113*a* and 1113*b* which are hermetically sealed in a glass tube 1114 together with an inert gas so that the contact parts 1112*a* at the ends of the reeds 1113*a* and 1113*b* overlap each other with a specified clearance provided between the two contacts. The contact part 1112*a* closes when an external magnetic field is applied thereto.

A magnet 1115 which is arranged above and in parallel with the reed switch 1112 with a specified clearance provided between the magnet 1115 and the reed switch 1112 and is fixed to the upper surface of the main casing 1111. The magnet 1115 is magnetized, for example, in a lengthwise direction of the reed switch 1112.

On the other hand, an electromagnetic shield tube (electromagnetic shield member) 1116 which magnetically isolates the reed switch 1112 from the magnet 1115 is arranged around the reed switch 1112 and is held against the main casing 1111 by springs 1117*a* and 1117*b* at both its ends so that the central part of the electromagnetic shield tube 1116 faces the contact part 1112*a* of the reed switch 1112.

The electromagnetic shield tube 1116 is formed with the same material such as, for example, carbon steel as for the springs 1117*a* and 1117*b* so that the electromagnetic shield tube 1116 is integral with the springs 1117*a* and 1117*b*.

In other words, as known from FIG. 11, a wire is wound at a fixed pitch around both end portions of the assembly unit which serves as the springs 1117*a* and 1117*b* and in high density around the central portion of the assembly unit which forms the electromagnetic shield tube 1116, thus forming the integrated construction.

The length of the electromagnetic shield tube 1116 is determined in consideration of the working value of the reed switch 1112, the magnitude of magnetism of the magnet 1115, and the spring constants of springs 1117*a* and 1117*b*.

The operation of the shock sensor with the above configuration is described below.

In a normal state where no shock is applied to the shock sensor, the electromagnetic shield tube 1116 is kept by the springs 1117*a* and 1117*b* at a position where the central part of the electromagnetic shield tube 116 is opposed to the contact part of the reed switch 1112, and this contact part 1112*a* of the reed switch 1112 is kept open because the magnetism from the magnet 1115 is shut off by the electromagnetic shield tube 1116 and therefore, the magnetism does not act on the contact part 1112*a*.

When a shock in a lengthwise direction of the reed switch 1112 is applied to the shock sensor in the normal state, a force in the direction opposite to the direction of the shock energy acts on the electromagnetic shield tube 1116 due to the reaction of the shock. The reaction force causes the electromagnetic shield tube 1116 to move against the resilience of the spring 1117*a* (or the spring 1117*b*) in a lengthwise direction of the reed switch 1112.

The magnetism from the magnet 1115 acts on the contact part 1112*a* of the reed switch 1112 owing to the movement of the electromagnetic shield tube 1116, so that the contact part 1112*a* is closed to make the reed switch 1112 conductive. The conductive reed switch 1112 allows the shock to be detected.

When the shock is released, the electromagnetic shield tube 1116 is returned to its original position in the normal state by the resilience of the spring 1117*b* (or the spring 1117*a*) to magnetically isolate the reed switch 1112 from the magnet 1115.

As a result, magnetism is prevented from acting on the contact part 1112*a* of the reed switch 1112, and thus this contact part opens.

The shock sensor according to the third embodiment of the present invention is adapted so that the electromagnetic shield tube 1116 which is lighter in weight than the magnet 1115 is moved to detect a shock. Therefore, in order to detect a shock in a lengthwise direction of the reed switch 1112, the shock sensor can be installed by appropriately setting the spring constants of the springs 1117*a* and 1117*b* so that the lengthwise direction of the reed switch 1112 is vertically set. Such being the case, the installing direction of the shock sensor is not limited.

The shock sensor according to the third embodiment of the present invention can be made of a reduced number of component parts by forming the electromagnetic shield member and springs as an integral assembly with the same material (electromagnetic mild steel) and consequently the assembly process can be more easy.

Moreover, the shock sensor can be checked for proper operation by externally applying electrical signals to it without applying a shock if the electromagnetic shield tube and springs are formed with a material such as carbon steel, which provides a magnetism shielding effect and is electrically conductive, so that electrical signals can be entered into the shock sensor.

Figure 13:
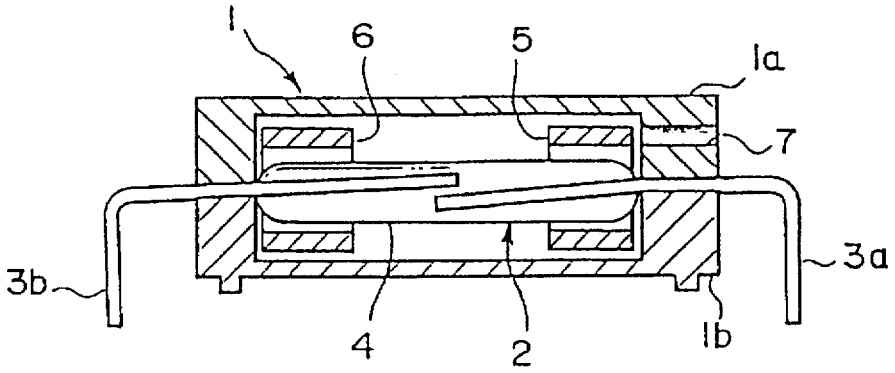
FIGS. 13 through 17 are respectively a partial cross-sectional approximate illustration of a fourth embodiment of the present invention.

FIG. 13 is a cross-sectional view showing a fourth embodiment of the present invention.

The shock sensor shown in FIG. 13 is adapted to house a reed switch 2 in a main casing 1 which comprises an upper casing 1*a* and a lower casing 1*b*.

The reed switch 2 comprises a pair of reeds 3*a* and 3*b* which are hermetically sealed in a glass tube 4 together with an inert gas so that the contact parts at the ends of the reeds 3*a* and 3*b* overlap each other with a specified clearance provided between the contact parts. The contact part is closed by applying an external magnetic field to it; that is, the reed switch 2 performs the so-called A-type operation.

The reed switch 2 thus configured is housed in the main casing 1, with both its ends supported, and a space of specified dimensions is provided between the internal surface of the main casing 1 and the external surface of the glass tube 4. First and second ring magnets 5 and 6 are arranged around the glass tube 4 so that the ring magnets 5 and 6 are freely movable in the lengthwise directions of the reed switch 2.

These first and second ring magnets 5 and 6 are arranged so that their opposing sides have the same polarity.

Figure 14:
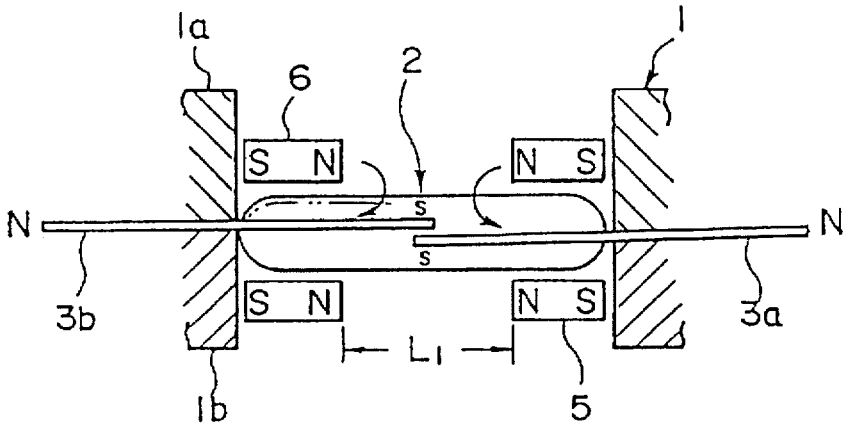

As shown in the illustration of the operating principle of FIG. 14, in the fourth embodiment, the first and second ring magnets 5 and 6 are arranged so that their opposing sides provide the N polarity. Therefore, the first and second ring type magnets 5 and 6 are kept away by the repulsive force of a magnetic field with a specified distance L1 therebetween in a normal state (regular condition).

As shown in FIG. 14, in the normal state, the reed 3*a* is magnetized so that its contact part side is provided with the S polarity while its output terminal side is provided with the N polarity. This is also the same with the reed 3*b*.

In other words, since the contact parts of the reed switch 2 are magnetized, in the normal state, to provide the same polarity, thereby contact parts repel each other and the reed switch 2 does not operate.

When the shock sensor is adapted so that the reed switch 2 does not operate in the normal state, it is desirable that the ring magnets 5 and 6 be arranged symmetrical in reference to the contact part of the reed switch 2.

Figure 15:
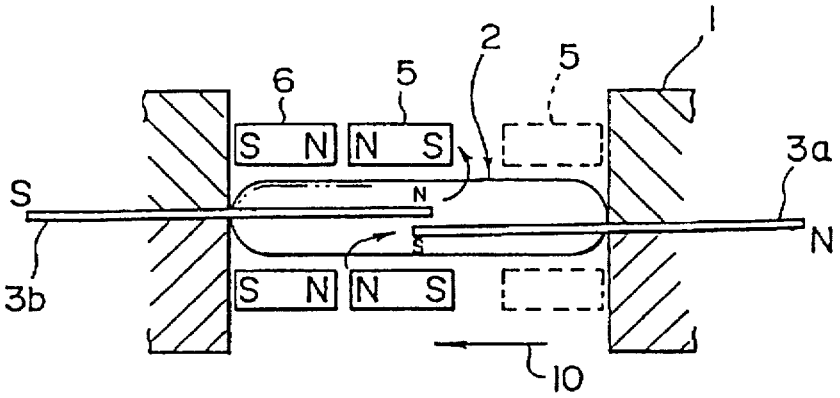

When a shock is applied to the shock sensor of the above configuration in the direction opposite to that of an arrowhead 10, the first ring magnet 5 moves in the direction of the arrowhead 10 as shown in FIG. 15. In this case, the polarity of the contact part side or output terminal side of the reed 3*a* does not change while that of the contact part side of the reed 3*b* changes to north and that of the output terminal side of the reed 3*b* changes to south.

Consequently, the contact parts of a pair of reeds 3*a* and 3*b* are magnetized to respectively provide different polarities, and these contact parts are brought into contact with each other by magnetism. In other words, the reed switch 2 is turned on to detect that an acceleration larger than specified acts on the shock sensor.

When the shock energy is eliminated, the first ring magnet 5 is returned to its original position by a repulsive force of magnetism as shown in FIG. 14. Specifically, the shock sensor operates within 2 to 5 msec from the instant a shock is applied, and carries out ON operation of the reed switch to close the contact parts for a period of 10 to 20 msec.

Figure 16:
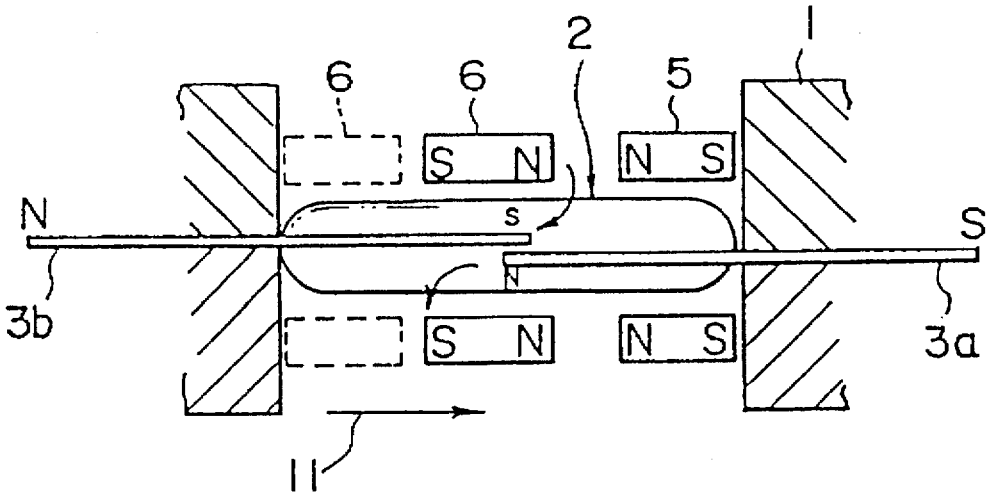

When a shock is applied from the direction opposite to the above-described direction, the second ring magnet 6 moves in the direction of an arrowhead 11 as shown in FIG. 16 to turn on the reed switch 2 as the first ring magnet 5 does.

Thus, the shock sensor is able to carry out the movement in response to a shock in two opposing directions.

In the fourth embodiment, a through-hole 7 is provided in the sidewall of the main casing 1 at, for example, the magnet 5 side to act a moving energy on the first ring magnet 5 from outside the main casing 1 in the direction toward the contact part of the reed switch 2.

By inserting a pin or the like through the through-hole 7 into the main casing 1 to push the first ring magnet 5, the first ring magnet 5 can be moved toward the contact part of the reed switch 2 against energization due to a magnetic repulsion force between the first and second ring magnets 5 and 6 and therefore, the reed switch 2 can be operated as in the case of FIG. 15.

Figure 17:
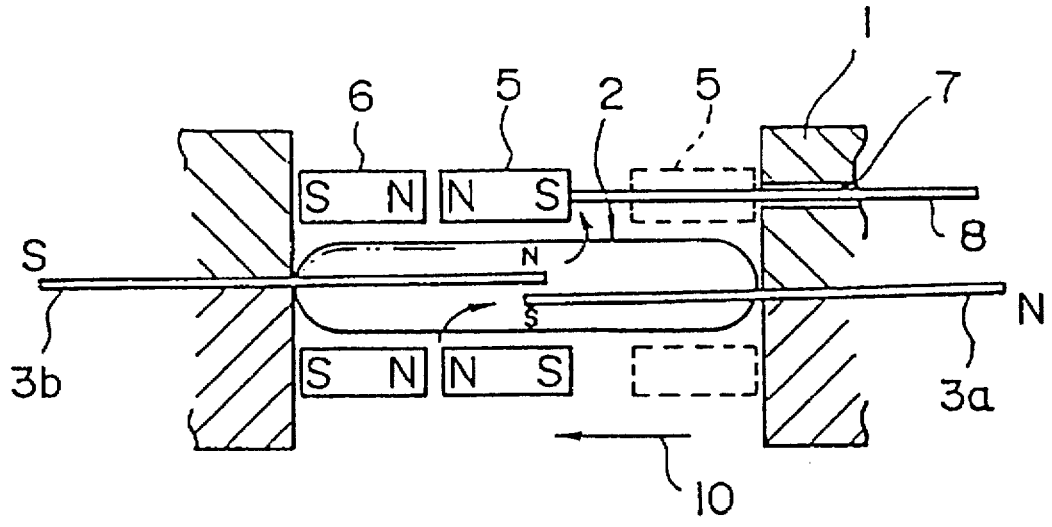

Accordingly, when the shock sensor is set on a selector and the reed switch 2 is operated by inserting a pin or the like through the through-hole 7 to move the first ring magnet 5 as shown in FIG. 17, the reed switch 2 can be operated without applying a shock. Therefore, when the shock sensor is incorporated in an automobile safety device, the shock sensor can be readily checked for proper operation and simultaneously the reed switch 2 can be tested for contact resistance.

Since the reed switch 2 can be easily operated without incorporating, in the shock sensor, an actuator for exclusive use in externally forcing the ring magnet 5 to move, the shock sensor can be economically checked for proper operation with simple provision of the through-hole 7.

In the above embodiment, though the through-hole 7 is provided in the sidewall of the main casing 1 at the ring magnet 5 side, clearly the through-hole 7 can be provided in the sidewall of the main casing 1 at the ring magnet 6 side. Using this hole, the reed switch 2 can be checked for proper operation when the second ring magnet 6 moves.

In the above embodiment, the through-hole 7 is provided in the sidewall of the main casing 1. However, the shock sensor of the present invention is not limited to such construction and, for example, a long, thin slit can be longitudinally formed in the main casing 1 to move the first and second ring magnets 5 and 6 using a pin or the like inserted through the slit into the main casing 1. In short, such construction is acceptable that forces can be applied to the first and second ring magnets 5 and 6 from outside the main casing 1 to move them toward the contact part of the reed switch 2.

By means of the above embodiment, description has been given of a shock sensor which uses the ring magnet 6 or 5 as means to make the ring magnet 5 or 6 move away from the contact part of the reed switch 2. However, the present invention is not limited to such shock sensors and can be applied to the shock sensors described under Background Art, which utilize springs.

As described above in detail, in accordance with the fourth embodiment of the present invention, the magnet can be moved by pushing it with a pin or the like inserted through a hole which is provided to apply a force to the magnet from outside the main casing for the purpose of moving the magnet toward the contact part of the reed switch 2. Therefore, the reed switch can be easily checked for proper operation without applying a shock to the shock sensor, and moreover, the reed switch can also simultaneously be tested for contact resistance with such operation check if the shock sensor is set on a selector.

Furthermore, since the magnet can be moved without incorporating, in the shock sensor, an actuator for exclusive use in externally forcing the magnet to move, the desired objects can be economically attained only by providing a through-hole.

Industrial Applicability

As described in detail above, the present invention enables to provide a shock sensor which can sense shocks to be applied in a number of directions.

In addition, in accordance with the present invention, a shock sensor which can be more easily checked for proper operation can be provided.

What is claimed is:

1. A shock sensor having:

a reed switch which is fixed inside a main casing and has a reed contact part which is switchable from a first state to a second state under the influence of magnetism;

a magnet which is fixed inside said main casing with a specified distance from said reed switch;

a shield member which has an area as large as sufficient to prevent magnetism from said magnet from affecting said reed contact part when said shield member is arranged at a regular position; and a plurality of resilient members which are connected between an end of said shield member and the main casing which keep said shield member between said reed contact part and said magnet, and which keep said reed contact part in said first state in a normal state and which change said reed contact part over to said second state when a shock is applied to said shock sensor, wherein said plurality of resilient members are springs.

2. A shock sensor according to claim 1, wherein said reed switch comprises two reeds each having reed contact pans, wherein said reeds extend in specified directions, and said plurality of resilient members also extend in said specified directions.

3. A shock sensor according to claim 1, wherein said main casing has an opening for testing said shock sensor by moving said shield member.

4. A shock sensor according to claim 3 further comprising a testing jig with a U-shaped abutment for insertion into said opening and pushing said shield member to test said shock sensor.

5. A shock sensor according to claim 1, wherein said reed contact part of said reed switch is hermetically sealed in a glass tube together with an inert gas.

6. A shock sensor having:

a reed switch which is fixed inside a main casing and has a reed contact part which is switchable from a first state to a second state under the influence of magnetism;

a magnet which is fixed inside said main casing with a specified distance from said reed switch;

a shield member which has an area as large as sufficient to prevent magnetism from said magnet from affecting said reed contact part when said shield member is arranged at a regular position; and a plurality of resilient members which are connected between an end of said shield member and the main casing which keep said shield member between said reed contact part and said magnet, and which keep said reed contact part in said first state in a normal state and which change said reed contact part over to said second state when a shock is applied to said shock sensor, wherein said reed switch comprises two reeds each having reed contact parts, wherein said reeds extend in sped fled directions, and said plurality of resilient members also extend in said sped fled directions and wherein said shield member is a tube and said reed contact parts are disposed within said tube, and wherein when said shock is applied to said shock sensor, said tube moves in a lengthwise direction from said regular position which allows magnetism from said magnet to affect said reed contact part to change over to said second state.

7. A shock sensor according to claim 6, wherein said magnet is a ring type magnet disposed around said tube shield member.

8. A shock sensor having:

a reed switch which is fixed inside a main casing and has a reed contact part which is switchable from a first state to a second state under the influence of magnetism;

a magnet which is fixed inside said main casing with a specified distance from said reed switch;

a shield member which has an area as large as sufficient to prevent magnetism from said magnet from affecting said reed contact part when said shield member is arranged at a regular position; and a plurality of resilient members which are connected between an end of said shield member and the main casing which keep said shield member between said reed contact part and said magnet, and which keep said reed contact part in said first state in a normal state and which change said reed contact part over to said second state when a shock is applied to said shock sensor, wherein said shield member is a flat plate of a rectangular shape and has a central portion between said magnet and said reed contact part when kept in a normal state and wherein said plurality of resilient members are comprised of three or more members connected to said plate and wherein said magnet is a rod type magnet.

9. A shock sensor according to claim 8 further comprising a partition between said shield member and said magnet to prevent said shield member from being magnetically attracted to said magnet.

10. A shock sensor according to claim 9, wherein said partition is comprised of vinyl chloride.

11. A shock sensor according to claim 8 further comprising a non-magnetic member formed on said shield member between said shield member and said magnet to prevent said shield member from being magnetically attracted to said magnet.

* * * * *